US005247795A

United States Patent [19]

McCullough

[11] Patent Number: 5,247,795

[45] Date of Patent: Sep. 28, 1993

[54] SCROLL EXPANDER DRIVEN COMPRESSOR ASSEMBLY

[75] Inventor: John E. McCullough, Carlisle, Mass.

[73] Assignee: Arthur D. Little, Inc., Cambridge, Mass.

[21] Appl. No.: 861,574

[22] Filed: Apr. 1, 1992

[51] Int. Cl.[5] ..... F02B 33/44

[52] U.S. Cl. ..... 60/605.1; 418/55.3; 418/60; 418/151; 417/407

[58] Field of Search ..... 418/55.1, 55.7, 55.3, 418/60, 151; 60/599, 605.1; 417/407

[56] References Cited

U.S. PATENT DOCUMENTS

| | | | |
|---|---|---|---|
| 1,041,721 | 10/1912 | Ball | 418/55.3 |
| 1,376,291 | 4/1921 | Rolkerr | 418/55.3 |
| 2,475,247 | 7/1949 | Mikulasek | 418/55.3 |
| 2,494,100 | 1/1950 | Mikulasek | 418/55.3 |
| 3,011,694 | 12/1961 | Audemar | 418/55.3 |
| 3,741,694 | 6/1973 | Parsons | 418/61 |
| 3,989,422 | 11/1976 | Guttinger | 418/55 |
| 4,192,152 | 3/1980 | Armstrong et al. | 62/402 |
| 4,341,070 | 7/1982 | Clark | 60/599 |
| 4,424,010 | 1/1984 | McCullough | 417/420 |
| 4,731,000 | 3/1988 | Haag | 418/55 |
| 4,795,323 | 1/1989 | Lessie | 418/55 |

FOREIGN PATENT DOCUMENTS

| | | | |
|---|---|---|---|
| 0026205 | 2/1982 | Japan | 418/55.1 |
| 0203801 | 12/1982 | Japan | 418/55.3 |
| 0277984 | 11/1990 | Japan | 418/55.3 |

*Primary Examiner*—Richard A. Bertsch
*Assistant Examiner*—Charles G. Freay
*Attorney, Agent, or Firm*—Bacon & Thomas

[57] ABSTRACT

An expander driven compressor assembly is disclosed comprising a scroll-type expander having at least one pair of meshed axially extending involute spiral wraps wherein one of the wraps orbits relative to the other wrap and a scroll-type compressor having at least one pair of relatively orbiting meshed axially extending involute spiral wraps. The orbital wrap of the expander is drivingly connected to the orbital wrap of the compressor through a common synchronizer and counterweight assembly. Auxiliary drive power developed by the expander and not required to drive the compressor is used to drive a power take-off shaft. In addition, expansion struts are proved to compensate for thermal expansion or contraction of the relatively orbiting scroll wraps. By this arrangement, a compact and efficient expander driven compressor assembly is achieved.

30 Claims, 5 Drawing Sheets

SCROLL EXPANDER DRIVEN COMPRESSOR ASSEMBLY

BACKGROUND OF THE INVENTION

1. Field of the Invention

The present invention pertains to a scroll-type expander-compressor drive system having a scroll-type expander which is used to drive a scroll-type compressor or pump. The scroll-type expander driven compressor system is particularly adaptable for use in combination with a combustor, such as an internal combustion engine, which produces exhaust gases for driving the scroll-type expander. The scroll-type expander may then drive the scroll-type compressor which can be used to supply pressurized air to the combustor or to drive other systems.

2. Description of the Prior Art

The use of a scroll-type expander driven compressor assembly in combination with a combustor is known in the art as exemplified by the teachings in U.S. Pat. No. 4,192,152. In such known arrangements, the exhaust gas from a combustor is used to drive an expander which is mounted upon a common shaft with a compressor. By this arrangement, the exhaust gas from the combustor drives the expander which, in turn, drives the compressor in order to provide pressurized air for the combustion process.

Such known expander-compressor drive systems have been found to be extremely efficient due to the inherent operating nature of scroll fluid devices. Unfortunately, the advantages of such drive arrangements have not heretobefore been fully realized due to various deficiencies associated with the prior art systems. For instance, such prior art systems have been rather bulky due to the manner in which the expander drives the compressor, the use of individual counterweights for the scrolls and the inclusion of separate synchronizers between the drive and driven scroll elements. In addition, when used in combination with a combustor, the scroll fluid devices are subject to a wide range of temperatures which tend to expand or contract the relatively rotating scroll elements which results in system vibrations, noise and efficiency losses.

Therefore, there exists a need in the art for a scroll-type expander driven compressor assembly which is compact, compensates for thermal expansion and contraction and which is simple in construction such that it can be readily manufactured with a minimum number of parts while being capable of a long service life.

SUMMARY OF THE INVENTION

In general, the present invention pertains to a compact scroll-type expander-compressor drive system including a scroll-type expander and compressor each of which includes a fixed element and an orbital element. A drive mechanism interconnects the orbital elements of the expander and compressor such that the orbital elements move in unison. The drive mechanism also incorporates a single synchronizer and counterweight assembly for both the expander and compressor. In the preferred embodiment, both the expander and compressor comprise dual or multi-stage scroll fluid devices having a central orbital element sandwiched between fixed scroll elements. In addition, at least one strut is interconnected between the fixed scroll elements to compensate for thermal expansion and/or contraction.

When used in combination with a combustor, the scroll-type expander in the present invention is driven by the hot exhaust gases emanating from the combustor and the output of the compressor is connected to the air input of the combustor. As the expander is driven by the hot exhaust gases, the drive mechanism causes the orbital element of the compressor to move relative to its fixed elements in order to pump intake air into the combustor. In a preferred embodiment, a heat exchanger is also provided to transfer heat from the output of the expander in order to preheat the air inputted to the combustor from the compressor.

Other objects, features and advantages of the invention shall become apparent from the following detailed description of a preferred embodiment thereof, when taken in conjunction with the drawings wherein like reference characters refer to corresponding parts in the several views.

DESCRIPTION OF A PREFERRED EMBODIMENT

Figure 1:
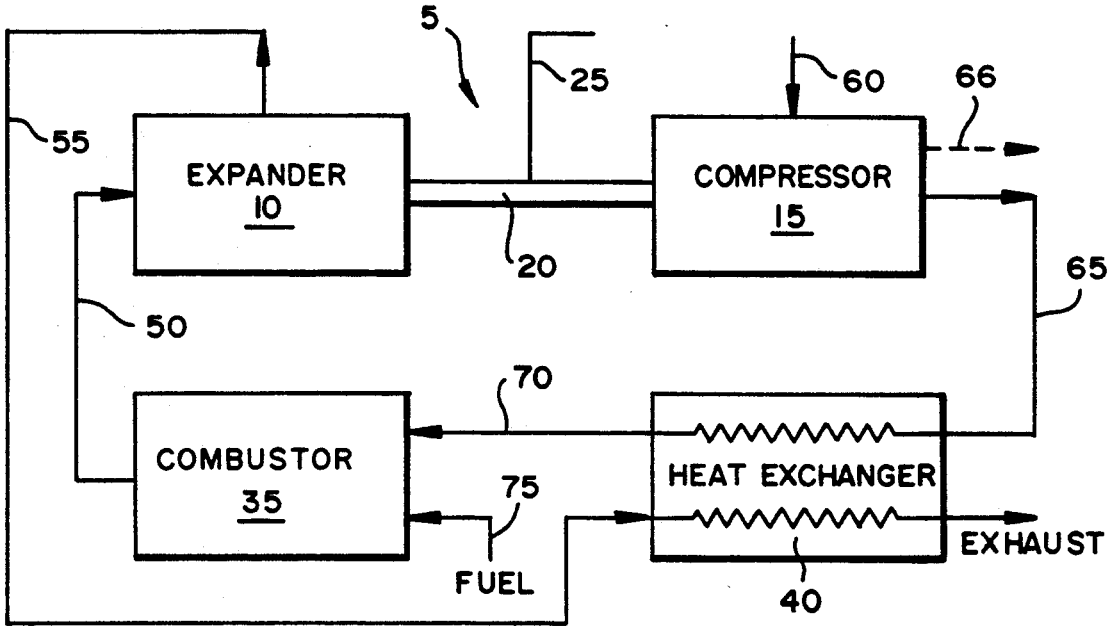
FIG. 1 is a schematic view of the scroll-type expander driven compressor system of the present invention in combination with a combustor arrangement.

Referring to FIG. 1, the scroll-type expander driven compressor system of the present invention is generally indicated at 5 and includes an expander 10 which drives a compressor 15 through a drive mechanism shown at 20. A power takeoff shaft 25 (hereinafter referred to as PTO) is also provided in the drive connection between expander 10 and compressor 15 and may be used to harness the auxiliarly power generated by expander 10 which is not needed to drive compressor 15.

In the schematic shown, the scroll-type expander-compressor system of the present invention is used in combination with a combustor 35 and a heat exchanger 40. The exhaust gas output from combustor 35 flows through a pipe 50 to an input of expander 10 to cause rotation of drive mechanism 20 and compressor 15 in a manner which will be described in detail below. The exhaust gases from expander 10 flow through duct 55 into heat exchanger 40 and are then exhausted. Driving of compressor 15 causes air to be drawn into intake duct 60 and compressed by compressor 15. The compressed air is expelled from compressor 15 into output pipe 65 and into heat exchanger 40 wherein it is preheated by the radiant heat from exhaust duct 55. The intake air is then directed through a conduit 70 to be mixed with fuel from an input fuel line 75 to form a charge for combustor 35. If desired, compressed air for other applications can be supplied from compressor 15 via line 66.

Figure 2:
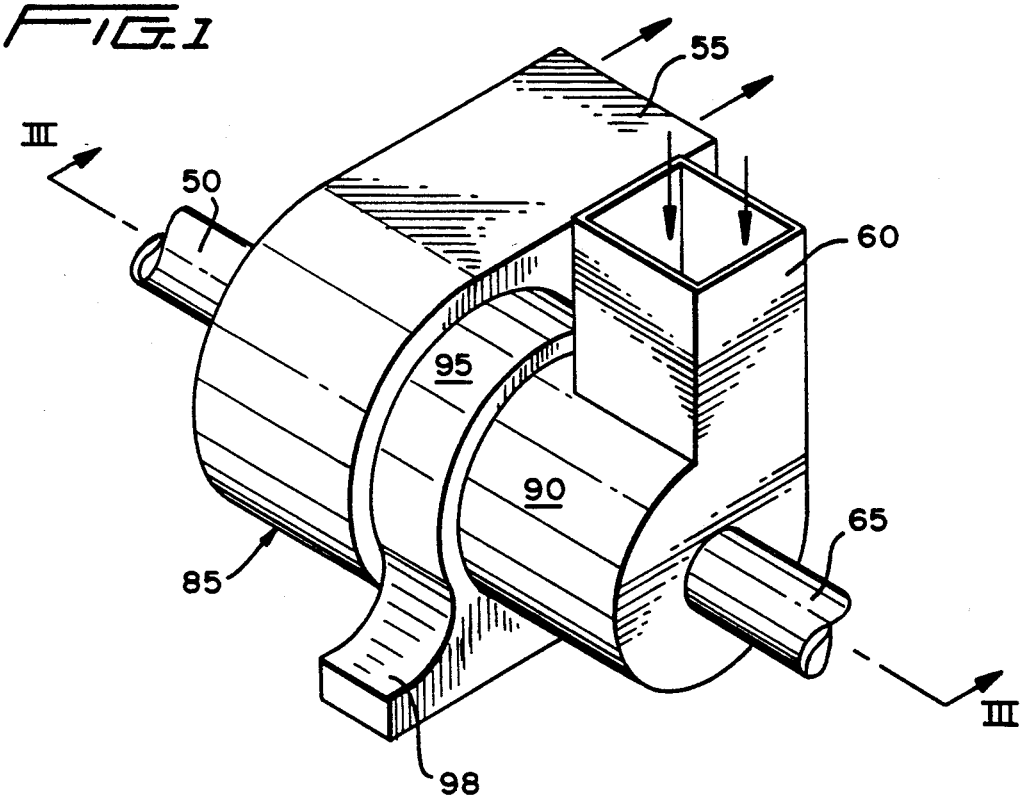
FIG. 2 is a perspective view of the expander-compressor assembly.

FIG. 2 shows a perspective view of the expander driven compressor assembly according to a preferred embodiment of the invention. As shown, expander 10 is located within an expander housing 85 and compressor 15 is located within a compressor housing 90. Expander housing 85 and compressor housing 90 are joined by an interconnecting sleeve member 95. Sleeve number 95 includes an integrally formed base portion 98 which can be used for fixedly mounting the expander driven compressor assembly.

Reference will now be made to FIGS. 3–6 in describing the individual elements of the expander driven compressor assembly of the present invention and the manner in which the assembly operates. It should be noted that a portion of the outer housing of the assembly is not shown in FIG. 4 for clarity. Within initial reference to FIG. 3, expander 10 comprises a dual or multi-stage expander having a first fixed involute spiral wrap 100 secured to a side wall 105 of expander housing 85 and an axially spaced second fixed involute spiral wrap 115 secured to or integrally formed with a wrap support plate 120. Located between sidewall 105 and wrap support plate 120 is an orbital scroll element including an elongated involute spiral wrap 125 and a wrap support assembly generally indicated at 130. Elongated involute spiral wrap 125 extends substantially the entire distance between sidewall 105 and wrap support plate 120 such that involute spiral wrap 125 meshes with both involute spiral wrap 100 and involute spiral wrap 115. Wrap support assembly 130 includes a plurality of radially extending plates (not individually labeled) which are interconnected at predetermined central locations between the flanges of involute spiral wrap 125. By this construction, a plurality of expansion chambers 160, 165 are defined between involute spiral wrap 125 and involute spiral wraps 100 and 115 respectively on either side of wrap support assembly 130. Wrap support assembly 130 includes at least one central aperture 180 which fluidly interconnects exhaust pipe 50 with expansion chamber 165.

Figure 7:
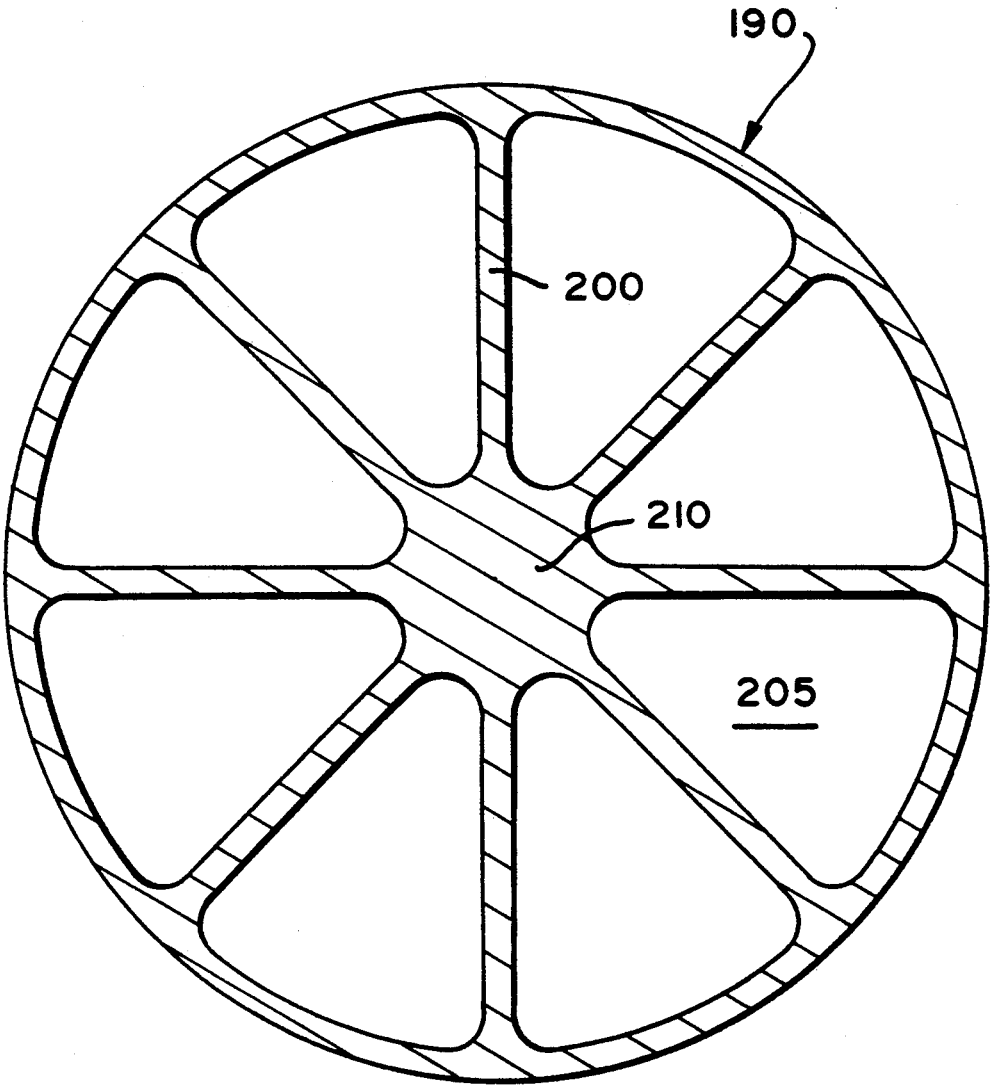
FIG. 7 depicts a spider structure incorporated in the expander-compressor assembly of the present invention.

The inlet from exhaust pipe 50 to expander 10 includes a spider structure 190 (see FIG. 7). Spider structure 190 may be integrally formed as part of sidewall 105 or may be fixedly secured within an inlet port formed in sidewall 105 or within exhaust pipe 50 adjacent the inlet area for expander 10. As shown in FIG. 7, spider assembly 190 includes various support ribs 200 defining fluid passageways 205 therebetween. Fixedly secured between a central structural support 210 for support ribs 200 and wrap support plate 120 is at least one expansion strut 225 (see FIG. 3). In the preferred embodiment, expansion strut 225 for expander 10 is of tubular construction and serves to compensate for thermal expansion and contraction of expander 10 as will be described more fully hereinafter.

From the above description, it can readily be seen that fluid flowing from exhaust pipe 150 will enter expansion chambers 160 and 165 in expander 10 through spider structure 190, will be expanded between the respective mesh spiral wraps 100, 125 and 115, 125 and will flow out exhaust duct 55. In this process, involute spiral wrap 125 will orbit relative to fixed involute spiral wraps 100 and 115 due to the presence of a synchronizer assembly which will be detailed below.

Compressor 15 is constructed in a manner substantially identical to the construction of expander 10 as described above in that it includes a single orbital scroll element axially located between first and second fixed scroll elements. The first fixed scroll element includes a first fixed involute spiral wraps 250 integrally formed with or otherwise fixedly secured to sidewall 255 of compressor housing 90. The second fixed scroll element includes a fixed involute spiral wrap 260 axially extending from a wrap support plate 270. The orbital scroll element includes an elongated involute spiral wrap 275 and a wrap support assembly 280. Involute spiral wrap 275 meshes with both involute spiral wraps 250 and 260. The flanges of involute spiral wrap 275 are interconnected by wrap support assembly 280 which includes a substantially centrally and axially extending aperture 285 therein.

By this construction, when involute spiral wrap 275 orbits relative to fixed involute spiral wraps 250, 260, fluid is drawn into intake duct 60, is compressed within compression chambers 300, 305 defined on either side of wrap support assembly 280 and is exhaust through output pipe 65.

The outlet zone between compressor 15 and output pipe 65 is provided with a spider structure 315 extending there across. Spider structure 315 is structurally identical to spider structure 190 described above with reference to FIG. 7. In addition, compressor 15 includes an expansion strut 335 which extends between and is fixedly secured to spider structure 315 and wrap support plate 270. Again, expansion strut 335 is intended to compensate for axial expansion and contraction of compressor 15 as will be more fully discussed below. In addition, involute spiral wrap 275 is permitted to orbit relative to involute spiral wraps 250 and 260 by means of a synchronizer which will be also detailed below.

Figure 3:
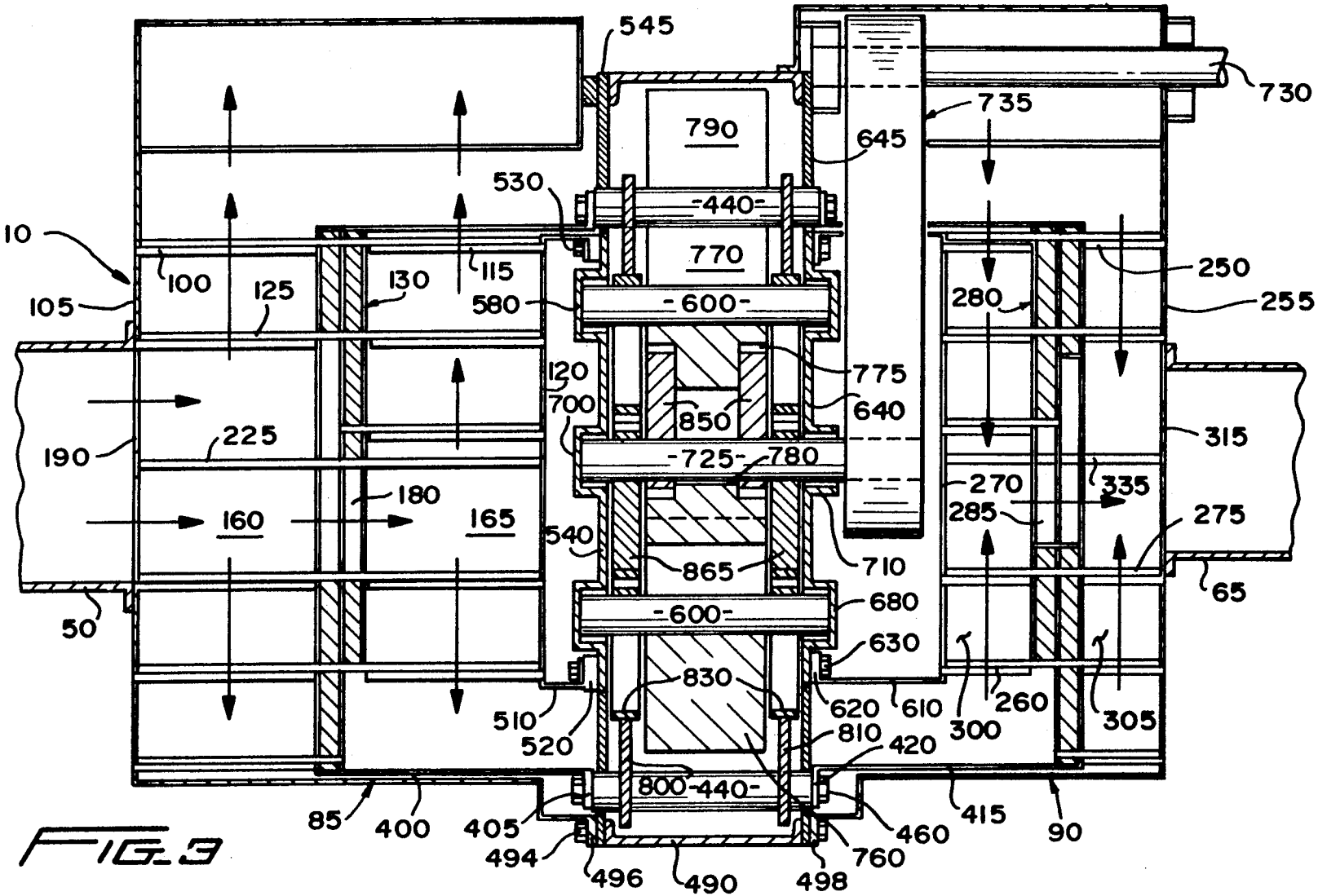
FIG. 3 is a cross-sectional view taken along line III—III of FIG. 2.
Figure 4:
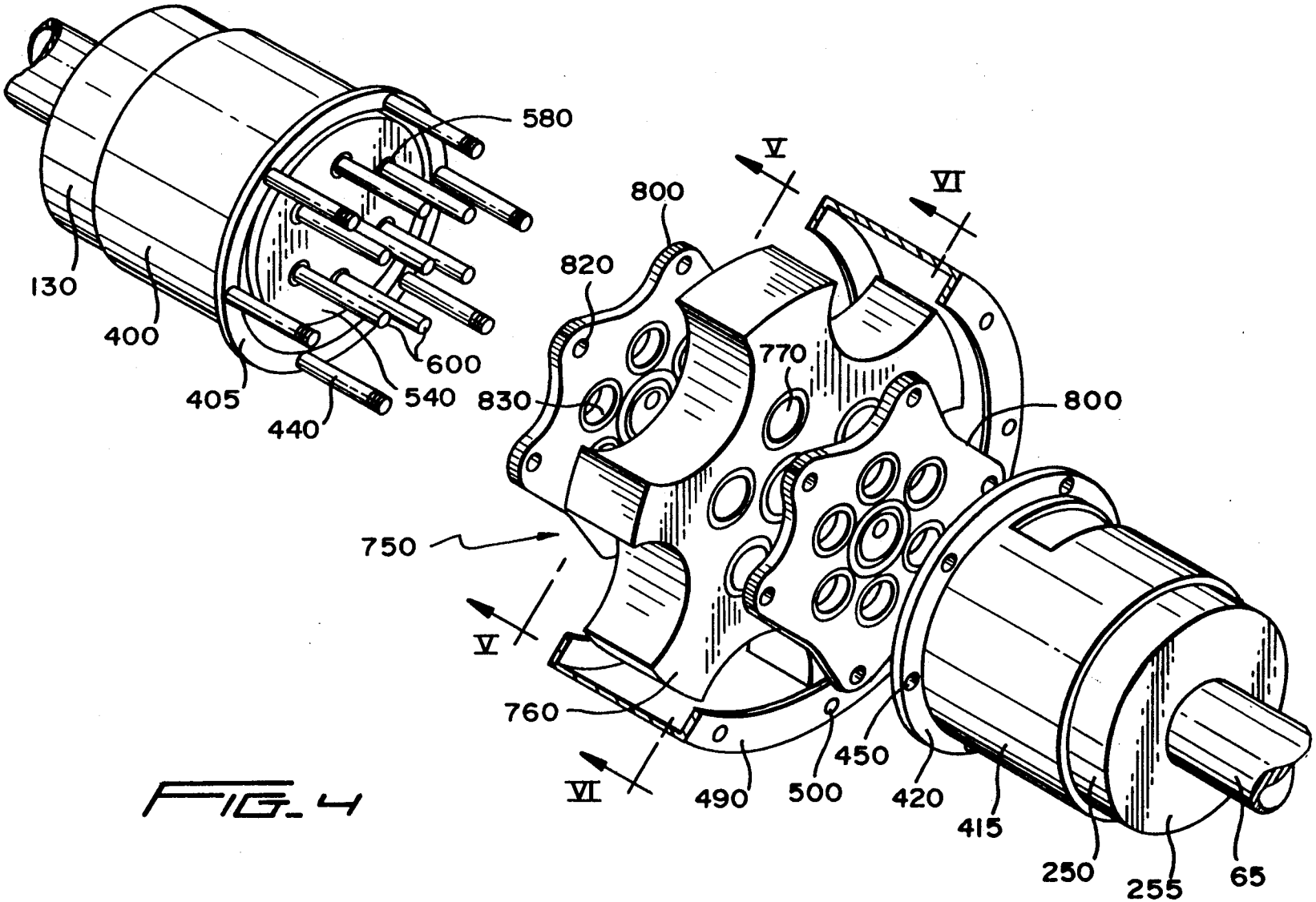
FIG. 4 is an exploded perspective view of the expander-compressor assembly according to the present invention with a portion of the outer housing not shown for clarity.

As best shown in FIGS. 3 and 4, wrap support assembly 130 of expander 10 is fixedly secured to an annular sleeve 400 which terminates in an inboard flange 405. Compressor 15 includes a similar annular sleeve 415 which also terminates in an inboard flange 420. Flanges 405 and 420 are interconnected by a plurality of drive posts 440 each having one end fixedly secured to flange 405 and a second, threaded end which extends through a respective aperture 450 in flange 420 and is secured thereto by a nut 460. Since wrap support assembly 130 of expander 10 and wrap support assembly 280 of compressor 15 are thereby fixedly secured together through drive post 440, wrap support assemblies 130 and 280 move in unison in their orbital paths. Therefore, when expander 10 is driven by the exhaust gases of combustor 35, compressor 15 will also be driven through drive post 440 which collectively comprises drive mechanism 20. Additional features of the drive arrangement between expander 10 and compressor 15 will be more fully explained hereinafter along with a synchronizer system which enables the movable scroll elements to orbit relative to the fixed scroll elements in both expander 10 and compressor 15 without relative rotation.

Expander housing 85, which includes sidewall 105, is fixedly secured to compressor housing 90 through a housing sleeve member 490. As shown in FIGS. 3 and 4, both expander housing 85 and compressor housing 90 are fixedly secured to housing sleeve member 490 by means of a plurality of bolts 494 which extend through holes formed in flanges 496 and 498 of expander housing 85 and expander housing 90 respectively and through apertures 500 formed in housing sleeve member 490. By this construction, expander housing 85 and compressor housing 90 can be integrally joined into a single operating unit as generally shown in FIG. 2.

Fixed wrap support plate 120 of second fixed involute spiral wrap 115 includes a plurality of axially extending legs 510 which terminate in inwardly projecting tabs 520. Tabs 520 are fixedly secured by means of bolts 530 to a first bearing support member 540. Bearing support member 540 is fixedly secured to sleeve member 490 through a plate or plates 545, spaced between consecutive drive posts 440, and is formed with a plurality of circumferentially spaced journal bearings 580. Freely rotatably mounted within journal bearings 580 are a plurality of rollers 600. In the preferred embodiment six such rollers 600 are arranged in a hexagonal pattern located a predetermined radial distance inward from drive posts 440.

In a manner directly analogous to that discussed above with respect to expander 10, wrap support plate 270 of fixed involute spiral wrap 260 of compressor 15 includes a plurality of inwardly projecting legs 610 which terminate in a plurality of tabs 620. Tabs 620 are secured by means of bolts 630 to a second bearing support member 640. Bearing support member 640 is fixedly secured to sleeve member 490 through a plate or plates 645, spaced between consecutive drive posts 440, and includes a plurality of journal bearings 680 which are axially spaced and opposed to journal bearings 580. As will be more fully explained below, rollers 600 extend between and are rotatably mounted within both journal bearings 580 and 680.

First bearing support member 540 also includes a central journal bearing 700 which is axially spaced from a centrally located aperture 710 formed in second bearing support member 640. As will be more fully explained below, a drive shaft 725 is freely rotatably mounted within central journal bearing 700 and extends through centrally located aperture 710. Drive shaft 725 is used to drive an auxiliary output shaft 730 through a belt drive arrangement generally indicated at 735.

Integrated with the drive arrangement between expander 10 and compressor 15 is a synchronizer and counterweight assembly generally indicated at 750 in FIG. 4. Synchronizer and counterweight assembly 750 includes a counterweight 760 having plurality of circumferentially spaced bores 770 aligned with journal bearings 580, 680. Counterweight 760 is also formed with a pair of centrally located recesses 775 on either side of counterweight 760 and a through hole 780 located slightly, radially offset from a center point of counterweight 760. Through hole 780 has a diameter greater than the diameter of drive shaft 725. Counterweight 760 is also formed with a plurality of notches 790 formed about its outer periphery. The size of notches 790 is determined based on the desired size and weight of counterweight 760 as will be more fully discussed below.

Located on either side of counterweight 760 is a pair of drive/synchronizer plates 800 and 810. Since plates 800 and 810 are identical in construction only one will be described with particular reference to FIG. 5 which depicts drive/synchronizer plate 800. Plate 800 is provided with a plurality of bores 820 spaced about its periphery. Bores 820 correspond in number to the number of drive posts 440. Located radially inward of bores 820, plate 800 includes a plurality of bores 830 corresponding in number to the number of rollers 600. In addition, plate 800 is formed with a central through hole 840.

Located within recesses 775 of counterweight 760 is a pair of cams 850 having through holes 860 which are aligned with through hole 780. A similar cam 865 having a through hole 870 is also provided in the central aperture 840 of each drive plate 800 and 810.

A detailed description will now be made with reference to the above described structure in describing the specific manner in which drive is transmitted from expander 10 to compressor 15 along with the manner in which the orbital movement of involute spiral wrap 125 is synchronized to the orbital movement of involute spiral wrap 275. In addition, the manner in which counterweight 760 functions to offset the radial forces developed during operation of expander 10 and compressor 15 will also be described.

Drive posts 440 extend through bores 820 in plate 800, within notches 790 in counterweight 760, through the corresponding bores 820 in plate 810, and are then secured within apertures 450 of inboard flange 420 as previously described. In this manner, plates 800 and 810 are fixedly secured to orbit with involute spiral wrap 125 of expander 10 and involute spiral wrap 275 of compressor 15. In addition, each roller 600 has a first end rotatably mounted within a respective journal bearing 580 of first bearing support member 540. Each roller 600 extends from its respective journal bearing 580 through apertures 830 in plate 800, bores 770 in counterweight 760, through the respective apertures 830 in plate 810 and have their other end rotatably mounted within journal bearing 680 of second bearing support member 640. The radii of bores 770 and apertures 830 are configured to equal the orbital radius of involute spiral wraps 125 and 275. Therefore, rollers 600 act on the inner surfaces of bores 770 and apertures 830 to support radial forces generated by the orbital movement of the orbital elements of expander 10 and compressor 15. This arrangement also functions as a synchronizer which acts between the first and second fixed involute spiral wraps 100, 115 and orbiting involute spiral 125 of expander 10 and the first and second fixed involute spiral wraps 250, 260 and orbital involute spiral wrap 275 of compressor 15 to prevent relative rotation between these elements; i.e., the phase relationship between scroll elements is maintained.

Figure 5:
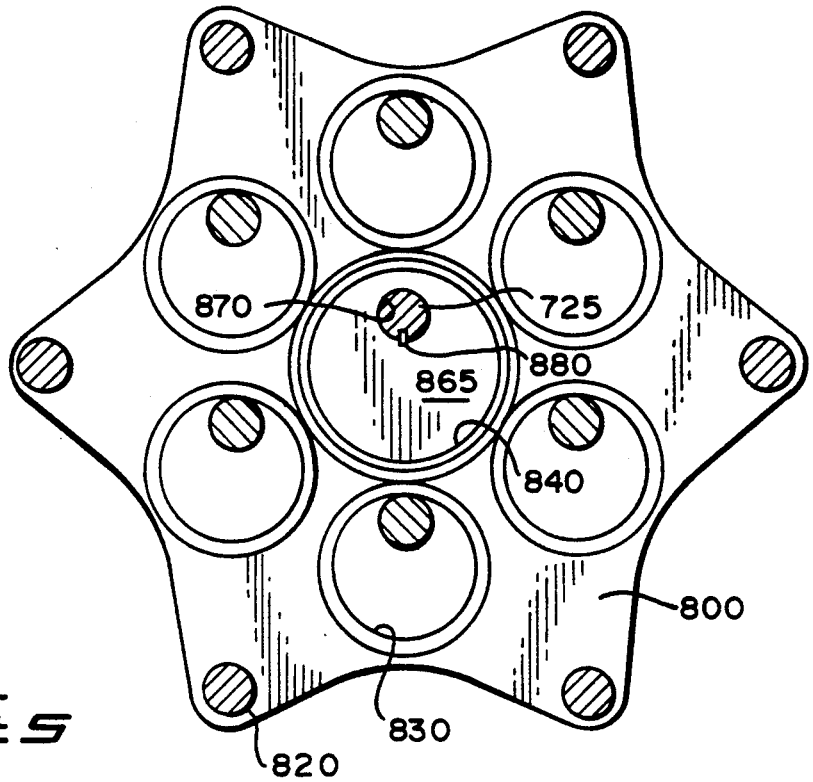
FIG. 5 is a front elevational view taken along line V—V of FIG. 4.
Figure 6:
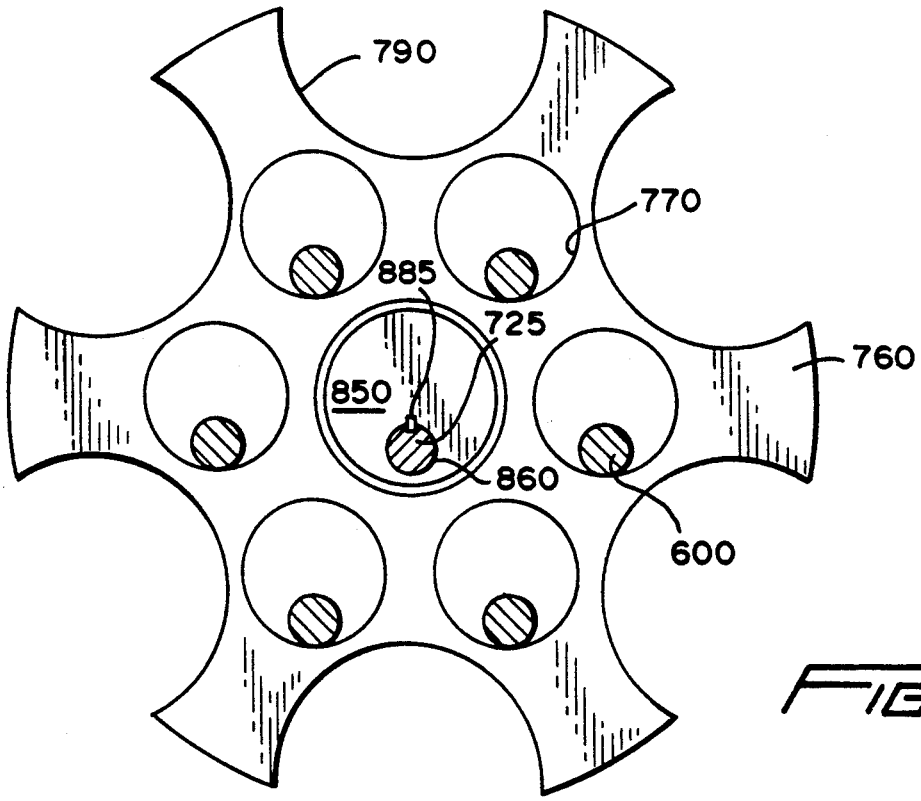
FIG. 6 is a front elevational view taken along lines VI—VI of FIG. 4.

In addition, drive shaft 725 is rotatably mounted within central journal bearing 700 at one end, is keyed to cams 850 and 865 at 880 and 885 respectively as shown in FIGS. 5 and 6 and has its second end rotatably mounted within centrally located aperture 710 of second bearing support member 640. From viewing FIG. 3, it becomes clearly evident that drive shaft 725 is retained axially by its connection to cams 850 and 865. From viewing FIGS. 5 and 6, it can be seen that as involute spiral wrap 125 of expander 10 orbits, plates 800 and 810 also orbit counter to counterweight 760. Of course, counterweight 760 orbits 180° out of phase with respect to the orbiting of plates 800 and 810. Since rollers 600 are fixed in the radial direction by journal bearings 580 and 680 as plates 800 and 810 orbit counter to counterweight 760, the rollers 600 act on the surfaces of their respective bores 770, 830. Since drive shaft 725 is keyed to cams 850 and 865, drive shaft 725 will rotate as plates 800, 810 and counterweight 760 orbit. Any power developed by orbiting of expander 10 by the combustion gases flowing into the inlet pipe 50 and not used to orbit compressor 15 may be taken off auxiliary drive shaft 730 by means of its interconnection with drive shaft 725 through drive transfer assembly 735. As shown, drive transfer assembly 735 comprises a belt drive system which cooperates with a pair of pulleys (not shown) respectively mounted on drive shaft 725 and auxiliary drive shaft 730, but a gear or a combination gear and chain transfer arrangement may also be utilized without departing from the spirit or scope of the present invention.

In the preferred embodiment, expander 10 is formed from steel and compressor 15 is formed from aluminum. The difference in radial forces developed during operation of expander 10 and compressor 15 is counteracted by counterweight 760. Notches 790 are sized to adjust the required counteracting or balancing mass.

When the scroll expander driven compressor assembly of the present invention is used in combination with a combustor as shown in FIG. 1, the exhaust gases entering expander 10 may be in the range of approximately 1100° F. Extreme temperature environments such as this results in thermal expansion between the orbital and fixed elements of the expander 10 and to a lesser degree in the compressor 15. To compensate for such thermal effects, expansion struts 225 and 355 are provided. Each expansion strut is formed from the same material as the component in which it is used. For example, strut 225 in expander 100 comprises a hollow steel rod. If temperature changes cause involute spiral wraps 100, 115 and 125 to expand or contract, strut 225 will expand or contract accordingly. Since the ends of wrap support plates 105, 120 are fixed to or form part of housing 85, strut 225 extends between only the middle portions of these plates which are inherently somewhat flexible.

It should be noted that although the present invention was described with respect to a particular embodiment of the invention, various changes and/or modifications may be made without departing from the spirit or scope of the present invention. For instance, the number of struts provided and the size and material of the expander and compressor are not critical to the invention. In general, the invention is only intended to be limited by the scope of the following claims.

I claim:

1. An expander driven compressor assembly comprising:

a scroll-type expander including at least one pair of meshed axially extending involute spiral wraps having involute centers and defining at least one expansion chamber between them that moves radially outward between expander inlet and outlet zones when one wrap is orbited along a circular path about an orbit center relative to the other wrap and wrap support means secured to and supporting each wrap;

fluid supply means for driving said expander by causing fluid to be delivered to said inlet zone and expanded through said at least one expansion chamber to said outlet zone thereby causing said at least one pair of wraps to orbit relative to each other;

a scroll-type compressor including at least one pair of meshed axially extending involute spiral wraps having involute centers and defining at least one compression chamber between them that moves radially inward between compressor inlet and outlet zones when one wrap is orbited along a circular path relative to the other wrap about an orbit radius;

means for drivingly interconnecting said scroll-type expander and said scroll-type compressor such that the relative orbital movement between said at least one pair of involute spiral wraps of said expander causes relative orbital movement between said at least one pair of involute spiral wraps of said compressor about said orbit radius thereby causing fluid to be drawn into the inlet zone of said scroll-type compressor, compressed through said at least one compression chamber and expelled through said compressor outlet zone, said interconnecting means including synchronizer means acting between said at least one pair of wraps of both said scroll-type expander and compressor to prevent relative rotation of one wrap of each pair relative to at least one other wrap of that pair while enabling relative orbital motion of the wraps about their respective orbit radii; and a power take-off mechanism including a drive shaft adapted to rotate with said interconnecting means.

2. An expander driven compressor assembly as claimed in claim 1, wherein said scroll-type expander and said scroll-type compressor are co-axially mounted.

3. An expander driven compressor assembly as claimed in claim 2, wherein said means for drivingly interconnecting said scroll-type expander and said scroll-type compressor is axially located between said expander and compressor.

4. An expander driven compressor assembly as claimed in claim 1, wherein said expander comprises first, second and third wrap support means, said first and third wrap support means being axially spaced with said second wrap support means being located therebetween, said second wrap support means having secured thereto and supporting an involute spiral wrap on each axial side thereof which are respectively meshed with the involute spiral wraps carried by said first and third wrap support means thereby defining a dual, scroll-type expander unit.

5. An expander driven compressor assembly as claimed in claim 4, wherein said second wrap support means of said expander includes a substantially, centrally located aperture formed therein.

6. An expander driven compressor assembly as claimed in claim 5, wherein said first and third wrap support means of said expander are interconnected by at least one axially extending strut.

7. An expander driven compressor assembly as claimed in claim 6, wherein said at least one strut is formed from the same material as said spiral wraps and wrap support means of said expander.

8. An expander driven compressor assembly as claimed in claim 7, wherein said material comprises steel.

9. An expander driven compressor assembly as claimed in claim 4, wherein said first and third wrap support means of said expander are fixed, said second wrap support means orbits relative to said first and third wrap support means, and said second wrap support means is drivingly connected to said means for drivingly interconnecting said expander and compressor.

10. An expander driven compressor assembly as claimed in claim 1, wherein said compressor comprises first, second and third wrap support means, said first and third wrap support means being axially spaced with said second wrap support means being located therebetween, said second wrap support means having secured thereto and supporting an involute spiral wrap on each axial side thereof which are respectively meshed with the involute spiral wraps carried by said first and third wrap support means thereby defining a dual, scroll-type compressor unit.

11. An expander driven compressor assembly as claimed in claim 10, wherein said second wrap support means of said compressor includes a substantially, centrally located aperture formed therein.

12. An expander driven compressor assembly as claimed in claim 11, wherein said first and third wrap support means of said compressor are interconnected by at least one axially extending strut.

13. An expander driven compressor assembly as claimed in claim 12, wherein said at least one strut is formed from the same material as said spiral wraps and wrap support means of said compressor.

14. An expander driven compressor assembly as claimed in claim 13, wherein said material comprises aluminum.

15. An expander driven compressor assembly as claimed in claim 10, wherein said first and third wrap support means of said compressor are fixed and said second wrap support means is drivingly connected to said means for drivingly interconnecting said expander and compressor such that said second wrap support means orbits relative to said first and third wrap support means.

16. An expander driven compressor assembly as claimed in claim 1, wherein said fluid supply means comprises an internal combustion engine, said fluid comprises exhaust gases from said internal combustion engine, and means for conveying such exhaust gases to said expander.

17. An expander driven compressor assembly as claimed in claim 16, wherein the fluid compressed by said compressor is air, and means for conveying said air to an air intake of said internal combustion engine.

18. An expander driven compressor assembly as claimed in claim 17, further comprising a heat exchanger including means for receiving the exhaust gases flowing from the outlet zone of said expander and the air flowing from the outlet zone of said compressor and causing them to counterflow in heat exchange relationships.

19. An expander driven compressor assembly as claimed in claim 3, wherein said interconnecting means comprises:

a first plate fixedly secured to orbit with said one wrap of said expander, said first plate including a first set of circumferentially spaced bores;

a second plate fixedly secured to orbit with said one wrap of said compressor, said second plate including a second set of circumferentially spaced bores axially aligned with said first set of bores;

a plurality of rollers each having first and second ends, each of said rollers extending through the aligned bores in said first and second plates; and means for supporting said first and second ends of each of said rollers, said supporting means being fixed with respect to said first and second plates.

20. An expander driven compressor assembly as claimed in claim 19, further comprising a counterweight having a third set of circumferentially spaced bores, each of said rollers further extending through a respective one of said third set of bores.

21. An expander driven compressor assembly as claimed in claim 19, wherein said supporting means comprises:

a first support member having a plurality of circumferentially spaced journal bearings, each journal bearing rotatably supporting the first end of a respective one of said rollers; and a second support member having a plurality of circumferentially spaced journal bearings, each journal bearing rotatably supporting the second end of a respective one of said rollers.

22. A scroll fluid device comprising:

a first support plate having first and second axially opposing faces;

a first involute spiral wrap fixedly secured to and extending axially from said second face of said first support plate;

a second support plate having first and second axially opposing faces;

a second involute spiral wrap fixedly secured to and extending axially from said first face of said second support plate;

a third support plate having first and second axially opposing faces;

third and fourth involute spiral wraps fixedly secured to and extending axially from said first and second faces of said third support plate respectively, said third and fourth involute spiral wraps being axially positioned between said first and second involute spiral wraps with said first and third spiral wraps and said second and fourth spiral wraps being respectively, axially meshed and defining at least one chamber between each pair of meshed spiral wraps that moves radially between an inlet zone and an outlet zone when one of the spiral wraps of each pair is orbited along a circular path about an orbit center relative to the other wrap of each pair; and expansion control means interconnecting said first and second support plates to control the axial spacing between said first and second support plates.

23. A scroll fluid device as claimed in claim 22, wherein said expansion control means comprises at least one axially extending strut.

24. A scroll fluid device as claimed in claim 23, wherein said at least one strut is secured between said second face of said first support plate and said first face of said second support plate and wherein said third support plate is formed with at least one aperture through which said at least one strut extends.

25. A scroll fluid device as claimed in claim 24, wherein said at least one strut is formed of the same materials as said first, second, third and fourth spiral wraps.

26. A scroll fluid device as claimed in claim 25, where said material is steel.

27. A scroll fluid device as claimed in claim 25, wherein said material is aluminum.

28. A scroll fluid device as claimed in claim 22, wherein said third support plate includes a substantially, centrally located aperture formed therein to interconnect one of said inlet and outlet zones with one of said chambers.

29. A scroll fluid device as claimed in claim 22, wherein said first and second support plates are fixed and said third support plate orbits relative to said first and second support plates.

30. A scroll fluid device as claimed in claim 22, wherein said third and fourth involute spiral wraps are formed as an integral unit.

* * * * *